United States Patent [19]

Ivanov et al.

[11] 4,315,701

[45] Feb. 16, 1982

[54] SHUTTERING FOR ERECTING A CONCRETE TUNNEL LINING

[76] Inventors: Valentin A. Ivanov, ulitsa Konstantinova, 4, kv. 25; Vladimir A. Khodosh, ulitsa Malaya Pirogovskaya, 27, korpus 1, kv. 11; Igor S. Ostrovsky, Otkrytoe shosse, 24, korpus 2, kv. 35; Mikhall Y. Shenkman, Otkrytoe shosse, 24, korpus 5g, kv. 37; Jury A. Koshelev, Ruzheiny pereulok, 4, kv. 123; Sergei N. Vlasov, Rizhsky proezd, 9, kv. 126, all of Moscow; Budu P. Pachulia, ulitsa Pavlova, 8a, kv. 4, Tbilisi; Iosif D. Y. Fishman, ulitsa Mashinostroitelei, 13, kv. 20, Donetskaya oblast, Yasinovatskaya, all of U.S.S.R.

[21] Appl. No.: 215,736

[22] Filed: Dec. 12, 1980

Related U.S. Application Data

[63] Continuation of Ser. No. 963,843, Nov. 27, 1978.

[30] Foreign Application Priority Data

Jan. 6, 1978 [SU] U.S.S.R. ..... 2565689

[51] Int. Cl.[3] ..... E21D 11/00; E21D 5/12

[52] U.S. Cl. ..... 405/150; 405/146

[58] Field of Search ..... 405/141–152; 299/31; 249/59

[56] References Cited

U.S. PATENT DOCUMENTS

| | | | |
|---|---|---|---|
| Re. 26,132 | 1/1967 | Cerutti | 405/150 X |
| 1,734,773 | 11/1929 | Murray | 405/150 X |
| 3,373,571 | 3/1968 | Records | 405/150 |
| 3,979,919 | 9/1976 | Blonde et al. | 405/146 |

FOREIGN PATENT DOCUMENTS

| | | | |
|---|---|---|---|
| 1163356 | 9/1958 | France | 405/146 |
| 871055 | 6/1961 | United Kingdom | 405/150 |

*Primary Examiner*—Dennis L. Taylor

*Attorney, Agent, or Firm*—Lilling & Greenspan

[57] ABSTRACT

The invention relates to a mechanism for stripping off pivotally interconnected vault segments of shuttering and includes two eccentric shafts interconnected by a connecting link which is mounted at the upper ends of said vault segments for rotation by a drive.

1 Claim, 2 Drawing Figures

SHUTTERING FOR ERECTING A CONCRETE TUNNEL LINING

This is a continuation of application Ser. No. 963,843, filed Nov. 27, 1978.

FIELD OF THE INVENTION

The invention relates to the construction of tunnels for various uses and other underground structures and, particularly, to shuttering for erecting a concrete tunnel lining.

The invention may be most advantageously used for the erection of concrete and cast in place injection moulded concrete lining.

Nowadays, a large number of designs of shuttering for erecting a concrete tunnel lining are known.

DESCRIPTION OF THE PRIOR ART

Known in the art are mobile shutterings for erecting concrete tunnel linings for tunnels driven by the mining method. The shuttering includes sections composed of pivotally interconnected individual members and a special shuttering transfer mechanism, comprising a self-propelled trolley designed for installation and transfer of these members.

With such construction of the shuttering, the sections thereof are assembled by means of the transfer mechanism and bolted together. Concrete is poured into the space behind the shuttering, and after the concrete hardens, the shuttering is disassembled into individual sections and transferred by means of the transfer mechanism to a new place to be re-assembled there.

Known in the art is mobile collapsible shuttering comprising welded tubings interconnected by bolts. The shuttering is assembled by means of a linkage type installation mechanism movable along arms fixed to lateral members of the shuttering. The shuttering is disassembled by means of an installation and transfer mechanism disposed at the end of the working zone.

Known in the art is a sectional displaceable shuttering used for erecting a cast in place injection moulded lining, comprising pivotally interconnected collapsible sections. A self-propelled mechanism is used for transfer and assembly of the sections. Each section of the shuttering consists of an upper part and a lower part. The upper part has two pivotally interconnected segments and the lower part consists of a segment to which there are articulated lateral pivotable segments. After the installation into the assembling position, the upper and lower parts of the section are interconnected into an integral structure by bolts.

The disadvantages of the prior art shuttering are their complicated structure, labour-consuming assembly and disassembly operations, the need to have a special sophisticated and cumbersome mechanism for stripping and transferring the sections of the shuttering. The employment of prior art displaceable and mobile shuttering is associated with labour-consuming operations of assembly, disassembly and displacement of sections, and with the need in sophisticated and cumbersome mechanisms for stripping the sections.

Known in the art are slip shuttering designs which are displaced without disassembly. They are, however, of a limited use, such as at straight tunnel portions only, and require large forces to be applied for their displacement along the tunnel.

Known in the art is an articulated mobile shuttering, comprising sections formed by pivotally interconnected individual members, and a self-propelled trolley for their installation and displacement. The sections are installed and filled with concrete in succession, in the direction of the face movement. After a lining ring gains a desired strength, the sections are successively collapsed using pivotable interconnection of the sections, and are transferred to a new position in front of the face in the collapsed form.

Such shuttering is installed in the following manner: the upper side sections are supported with their lower members by wedges and connected by bolts to adjacent sections. A section transferred in a collapsed form is lifted by a pair of swinging hydraulic cylinders, and then two pairs of horizontal screw jacks pivotally connected to the section installed the section into a design position. The lower members of the section supported by ropes of winches mounted on the trolley are lowered under gravity. The support members are wedged up and secured by anchor rods inserted in short boreholes drilled in the sole of a mining excavation. The installed section is then connected by bolts to adjacent sections. The shuttering is dismantled in the following manner. The trolley is wheeled up to the section to be removed and is connected thereto by jacks. Then the bolts connecting the section to the base and to the adjacent section are removed, and the lower member is stripped off by means of screws and screw tie rods, whereafter the lower members are pulled by the winch to under the trolley platform. The upper part is stripped off by means of the jacks of the trolley, which transfer the section into the transportation position.

The disadvantage of this design of the shuttering is the need to use a cumbersome and sophisticated mechanism for stripping off and transfer of the shuttering.

SUMMARY OF THE INVENTION

The main object of the invention is to provide for stripping of shuttering and its displacement inside the lining without disconnecting the shuttering members from one another.

Another object of the invention is to provide a construction which does not necessitate the use of sophisticated mechanisms for shuttering transfer.

It is also an object of the invention to simplify the construction of the arrangement and reduce labour requirements for its manufacture.

Further object of the invention is to reduce labour requirements for the use of shuttering in the tunnel construction.

Still another object is to improve the tunnel lining speed.

These and other objects are accomplished by a shuttering according to the invention for erecting a concrete tunnel lining, defining a closed outline and comprising a pivotally interconnected base segment and vault segments, and having a drive mechanism for stripping the segments off the tunnel lining, according to the invention. The mechanism comprises two parallel eccentric shafts interconnected by means of a connecting link and mounted at the upper ends of the segments for rotation by a drive.

The position of one of the eccentric shafts relative to upper segments is preferably adjustable by means of a wedge. That is, the outer contour or perimeter is adjustable by inserting a wedge anywhere at a break in the upper segment to enlarge the size thereof as desired.

The invention basically resides in the following.

When jacks of the eccentric mechanism are actuated, their piston rods are retracted into cylinders to turn levers connected to the eccentric shafts interconnected by the connecting link which ties together the upper ends of the vault segments. During rotation of the eccentric shafts the upper ends of the vault segments are moved towards one another, and their arms abut against a bolt with their stop screws. The upper segments are stripped off concrete concurrently with the lower segment of the shuttering in case the whole lining section was cast at once, including the base slab or the vault. In order to adjust the amount of stripping of the shuttering off lining, the position of one of the eccentric shafts may be adjusted by means of a wedge.

The shuttering for erecting a concrete tunnel lining according to the invention enables the stripping and transfer of shuttering without disconnecting the members thereof from one another thus substantially accelerating the tunnel lining operations.

BRIEF DESCRIPTION OF THE DRAWINGS

The invention will now be described in detail with reference to a specific embodiment thereof taken in conjunction with the accompanying drawings, in which.

DETAILED DESCRIPTION OF THE INVENTION

Figure 1:
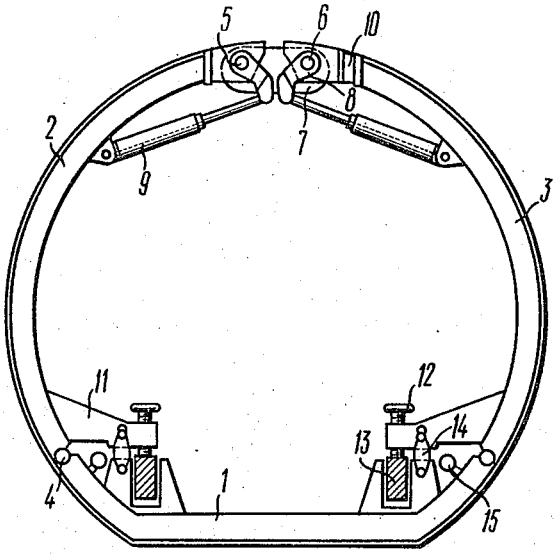
FIG. 1 is an elevational, cross-sectional view of shuttering for erecting a tunnel lining.
Figure 2:
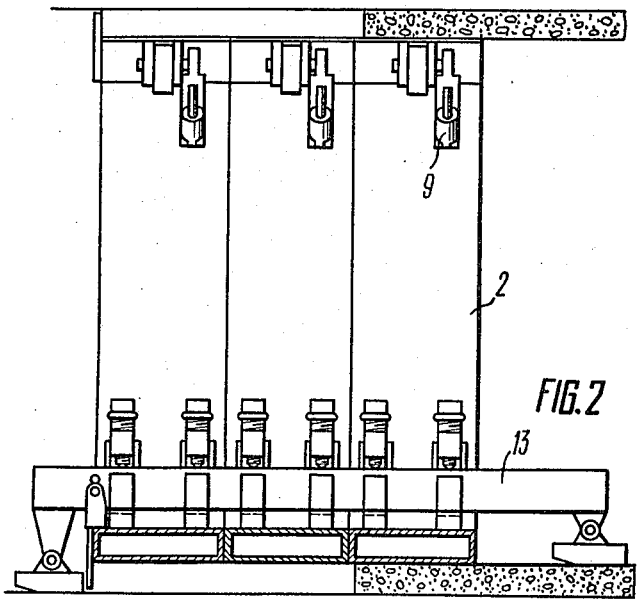
FIG. 2 is a side longitudinal view of shuttering shown in FIG. 1.

Shuttering according to the invention (FIGS. 1, 2) comprises a lower segment 1 and two upper segments 2 and 3. The lower segment 1 is connected to the two upper segments 2 and 3 by means of pivoted joints 4. The upper segments are connected together by a thrust mechanism comprising two parallel eccentric shafts 5 and 6 interconnected by means of a connecting link 7. The parallel eccentric shafts, as known to those in this art, may be made to include an eccentricity of some type in connection with which the connecting link engages. A lever 8 rigidly secured to the eccentric shaft is connected to a piston rod of a jack 9 secured to a lug of the upper segment 2. A wedge 10 may be inserted in the upper member at any location to change the outer perimeter and adjust the outer dimension of the shuttering as desired.

The upper segments 2 and 3 of the shuttering are provided, adjacent the joints 4, with arms 11 having stop screws 12 at their ends which can abut against girders 13 disposed thereunder. The girders are supported at their ends either by adjacent sections of the shuttering defining a preliminarily cast base of the tunnel gallery or by the trough-shaped part of the gallery and erected tunnel lining.

To limit the rotation of the segments beyond the inner outline of the concrete lining, there are provided connecting links 14 pivotally connected to the lower segment 1 of the shuttering and to the arms 11 of the upper segments. One hole of each connecting link 14 is elongated to enable the rotation of the upper segments to the interior relative to the outline. The shuttering is divided into sections interconnected by jacks 15 ensuring successive displacement thereof along the tunnel gallery without auxiliary trolleys.

The shuttering for erecting a concrete tunnel lining functions in the following manner.

After the casting, and after the concrete gains a desired strength, the jacks 9 of the eccentric mechanism are actuated, the piston rods are retracted into the cylinders to turn the levers 8 connected to the eccentric shafts which are caused to rotate to bring closer to one another the upper segments 2 and 3. The segments are thus caused to turn and to abut with their stop screws against the girders 13. The upper segments are stripped off concrete concurrently with the lower segment of the shuttering in case the whole lining section was cast at once, including the base slab or vault.

After the entire shuttering has been stripped, its sections are transferred forward along the girders 13 while being supported by the stop screws 12. The stop screws 12 may abut against the girder, e.g. by means of roller supports (not shown). The shuttering sections are successively displaced along the gallery by means of the jacks 15. In case the base and walls of the tunnel are cast concurrently (FIG. 2), the girders are supported at their ends by the cast base, the opposite ends of the girders being supported by the gallery floor. The girders have adjustable supports to ensure the installation of the shuttering in accordance with surveyor's marks.

Contrary to prior art structures, the shuttering according to the present invention is much simpler. No disconnection of individual members of the shuttering is required to strip the shuttering off concrete and to transfer it inside the cast lining. The use of the shuttering according to the invention enables the employment of cumbersome transfer mechanisms associated with the laying of additional rail tracks to be eliminated; labour requirements for shuttering transfer are considerably reduced, and metal consumption is reduced as well. The construction according to the invention makes it possible to avoid interruptions of tunnel driving operations, which would otherwise be necessary due to the need of dismantling water and air supply pipelines and ventilation systems. The possibility of adjusting the outside diameter of the shuttering enables its employment at curvilinear portions of the tunnel path.

What is claimed is:

1. Shuttering for erecting a concrete tunnel lining, comprising: vault segments and a base segment which are pivotally interconnected and define a closed outline; a drive mechanism for stripping said segments off the tunnel lining; said drive mechanism mounted at the upper ends of said vault segments for rotation by a drive and comprising two parallel rotatably disposed shafts having cylindrical eccentrics which shafts are located at the upper ends of said vault segments and are interconnected by means of a connecting link having cylindrical holes at the ends thereof, said cylindrical eccentrics being mounted for rotation in said cylindrical holes in said link such that rotation of said shafts causes the vault segments to close inwardly.

2. Shuttering as claimed in claim 1, wherein said drive includes two hydraulic jacks, each of which is pivotally connected to one of said segments at one end thereof, and each of which is connected to a lever rigidly connected to one of said shafts at the other end thereof.

* * * * *